US009681745B2

(12) United States Patent
Goldman

(10) Patent No.: US 9,681,745 B2
(45) Date of Patent: Jun. 20, 2017

(54) DEVICE AND METHODS FOR EXTENDING A COUNTERTOP

(71) Applicant: Pam Goldman, New York, NY (US)

(72) Inventor: Pam Goldman, New York, NY (US)

( * ) Notice: Subject to any disclaimer, the term of this patent is extended or adjusted under 35 U.S.C. 154(b) by 0 days.

(21) Appl. No.: 15/234,271

(22) Filed: Aug. 11, 2016

(65) Prior Publication Data

US 2017/0049222 A1 Feb. 23, 2017

Related U.S. Application Data

(60) Provisional application No. 62/207,807, filed on Aug. 20, 2015.

(51) Int. Cl.

| | |
|---|---|
| ***A47B 1/04*** | (2006.01) |
| ***A47B 13/08*** | (2006.01) |
| ***A47B 17/03*** | (2006.01) |
| *A47B 21/03* | (2006.01) |
| *A47B 97/00* | (2006.01) |

(52) U.S. Cl.

CPC ..... *A47B 1/04* (2013.01); *A47B 13/08* (2013.01); *A47B 17/033* (2013.01); *A47B 21/03* (2013.01); *A47B 97/00* (2013.01)

(58) Field of Classification Search

CPC ..... A47B 1/00; A47B 1/04; A47B 1/08

USPC ..... 108/65, 69

See application file for complete search history.

(56) References Cited

U.S. PATENT DOCUMENTS

| | | | | | |
|---|---|---|---|---|---|
| 84,549 | A * | 12/1868 | Hotchkiss | A47B 1/00 | 108/65 |
| 141,985 | A * | 8/1873 | Bennor | A47B 1/04 | 108/69 |
| 160,901 | A * | 3/1875 | Hamlin | A47B 1/04 | 108/119 |
| 937,639 | A * | 10/1909 | Paulsen | A47B 1/04 | 108/69 |
| 1,048,596 | A * | 12/1912 | Sedaj | A47B 1/04 | 108/69 |
| 1,472,129 | A * | 10/1923 | Meixell | A47B 57/00 | 108/69 |
| 1,907,242 | A * | 5/1933 | Chester | A47B 1/08 | 108/129 |
| 2,472,676 | A * | 6/1949 | Nunnally, Sr. | D06F 81/003 | 108/69 |
| 2,837,219 | A * | 6/1958 | Ferdinand | A47B 57/485 | 108/185 |
| 2,942,921 | A * | 6/1960 | Rachman | A47B 3/0916 | 108/26 |
| 2,955,888 | A * | 10/1960 | Graves | A47B 1/056 | 108/69 |
| 3,138,121 | A * | 6/1964 | Petrone | A47B 1/08 | 108/69 |
| 6,354,658 | B1 * | 3/2002 | Sher | A61G 5/1094 | 248/918 |
| 6,568,308 | B2 * | 5/2003 | Ricker | B23D 47/025 | 108/69 |
| 7,862,111 | B2 * | 1/2011 | Steenson | A47C 7/70 | 108/157.1 |

(Continued)

*Primary Examiner* — Jose V Chen

(74) *Attorney, Agent, or Firm* — Thomas A. O'Rourke; Bodner & O'Rourke, LLP

(57) ABSTRACT

A portable detachable counter extension system uniquely mounts on top of an already existing surface including but not limited to a counter, bookshelf, radiator cover, bathroom vanity or any other suitable existing suitable surface.

4 Claims, 7 Drawing Sheets

(56) References Cited

U.S. PATENT DOCUMENTS

| | | | | |
|---|---|---|---|---|
| 8,079,553 | B1 * | 12/2011 | Martin | A47C 7/543<br>108/135 |
| 8,584,598 | B2 * | 11/2013 | Derkoski | A47B 3/06<br>108/14 |
| 2006/0102056 | A1 * | 5/2006 | Wolfe | A47B 1/04<br>108/65 |

* cited by examiner

DEVICE AND METHODS FOR EXTENDING A COUNTERTOP

STATEMENT REGARDING FEDERALLY SPONSORED RESEARCH

NA

FIELD OF THE INVENTION

The present invention relates to devices and methods for providing a countertop extension.

BACKGROUND OF THE INVENTION

Counter space is a valuable commodity. Counter space is used for a seemingly endless variety of uses including eating, working, preparing food and the like. A lack of counter space, especially in circumstances wherein the overall space is limited, can be a serious problem. This is particularly notable in small apartments (many with narrow so-called 'galley' kitchens), mobile homes, recreational vehicles, boats, dormitories, nursing homes assisted living facilities, medical and dental offices and the like. Extended counter space also offers accessibility for the disabled and elderly, providing extra room to accommodate wheelchairs and walkers.

SUMMARY OF THE INVENTION

As specified in the Background Section, above, there is a need in the art for devices and methods that provide additional counter space easily and affordably.

Thus, in one aspect, the present invention provides a portable detachable counter extension system that uniquely mounts on top of an already existing surface including but not limited to a counter, bookshelf, radiator cover, bathroom vanity or any other suitable existing suitable surface. The countertop extension portion further comprising a substantially fiat surface or 'tray' and at least two extension arms, the extension arms each further comprising a terminal end wherein the terminal end further comprises a first quick release connector mechanism and at least 2 anchor portions, which also may be components of a single mounting strip with industrial strength adhesive on its underside, protected by peel-off tape, which remains affixed to the existing counter or other suitable surface, for connection to an existing countertop or other suitable surface and further comprising a second quick release connector mechanism wherein the first quick release connector mechanism and the second quick release connector mechanism join to reversibly detach the countertop extension portion from the mounting strip and therefore from the existing countertop or other suitable surface.

In another embodiment the present invention is a method for providing additional counter space comprising the steps of affixing at least 2 quick release anchor portions to an existing countertop or other suitable surface, and attaching to the quick release anchor portions a countertop extension portion thereby providing additional counter space as needed.

DETAILED DESCRIPTION OF THE INVENTION

The present invention provides systems and methods for providing additional counter space where needed.

FIG. 1 shows an embodiment of the invention of the present disclosure. In this embodiment a countertop extension portion 10 is provided that reversibly attaches to an existing countertop or other suitable surface by way of the provided anchor portions. The countertop extension portion 11 comprises a substantially flat surface and at least 2 extension arms 12 and 13. The substantially flat surface may be made from any suitable materials known to those having skill in the art including but not limited to plastic, glass, wood, and metal. The extension arms are attached to the substantially flat portion, in some embodiments on or about the edges of the substantially flat portion. In some embodiments the extension arms are of an adjustable length. The extension arms may be made of any suitable material known to those having skill hi the art, in this example, aluminum. The anchor portions are affixed to an existing countertop or other suitable structure by any attachment mechanism known to those having skill in the art, in this case with 3M industrial strength adhesive 14 applied to the underside of a mounting strip 15, the adhesive being covered by protective peel-off tape or with screws if the existing suitable surface can accommodate them. The anchor portions further comprise a quick release mechanism allowing the reversible connection to the extension arms. In this embodiment, the terminal ends of the extension arms fit within a cavity 16 in the anchor portions and lock in place by way of a groove on the upper inside surface of the anchor portion engaging with a raised portion on the terminal end of the extension arms.

FIG. 2(*a*) shows additional various views of an exemplary embodiment of anchor portions 30-32 used in the systems of the present disclosure.

Figure 1:
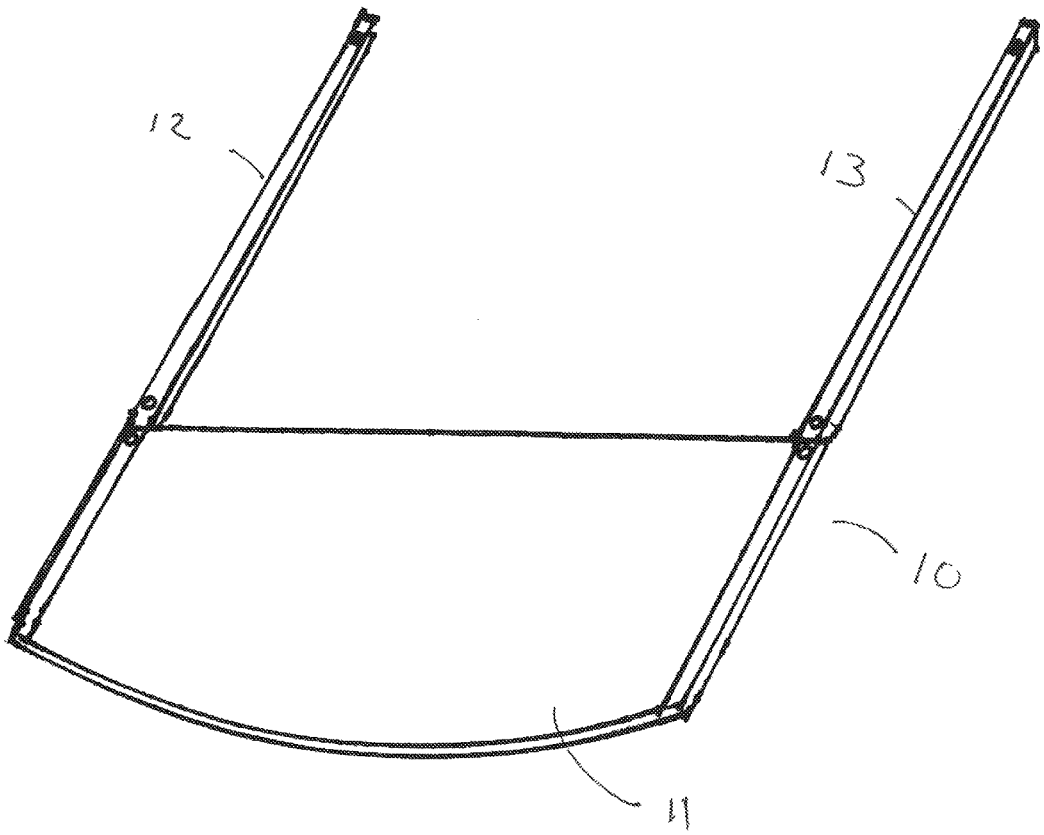
Figure 2:
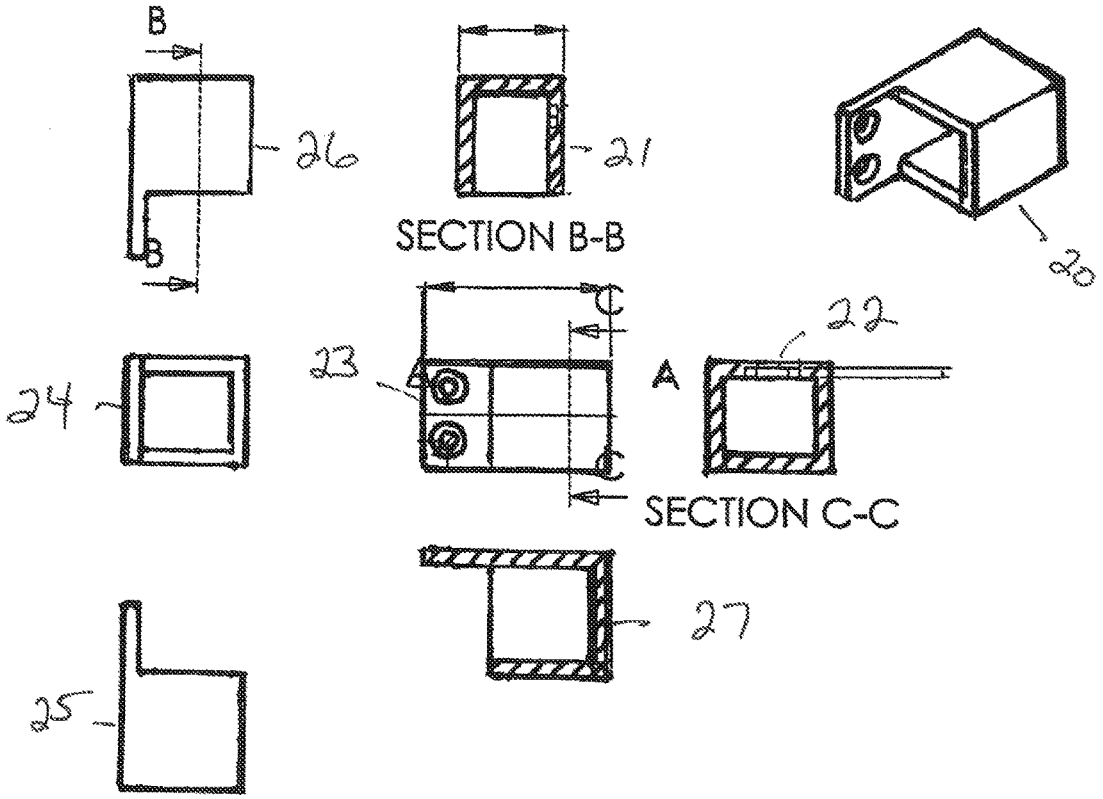
FIG. 2 shows various views of an exemplary of anchor portions 20-27 used in the systems of the present disclosure.
Figure 2:
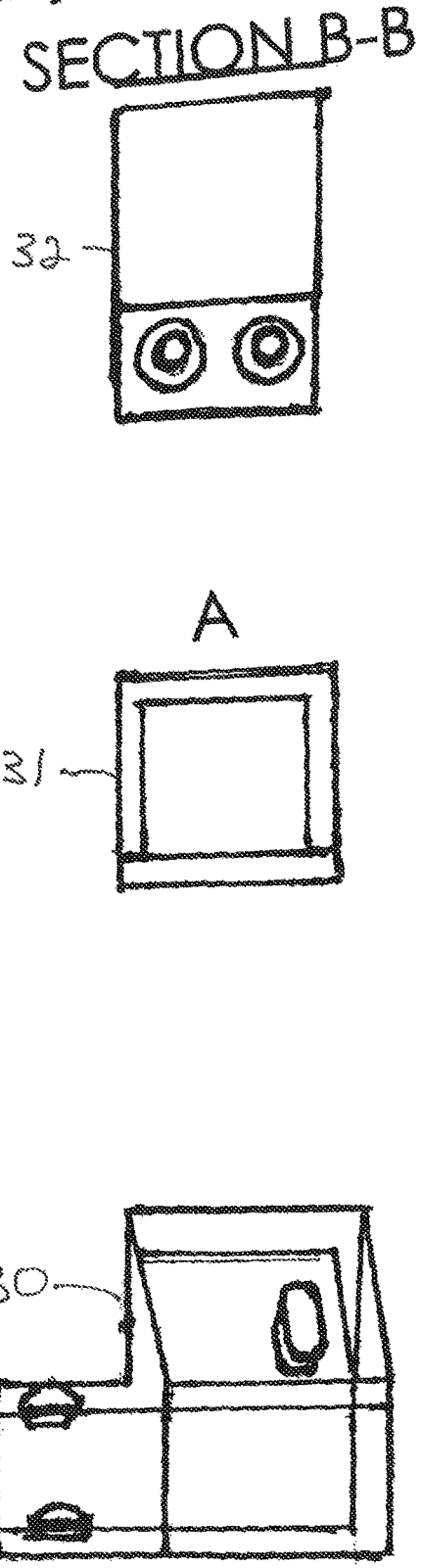
Figure 3:
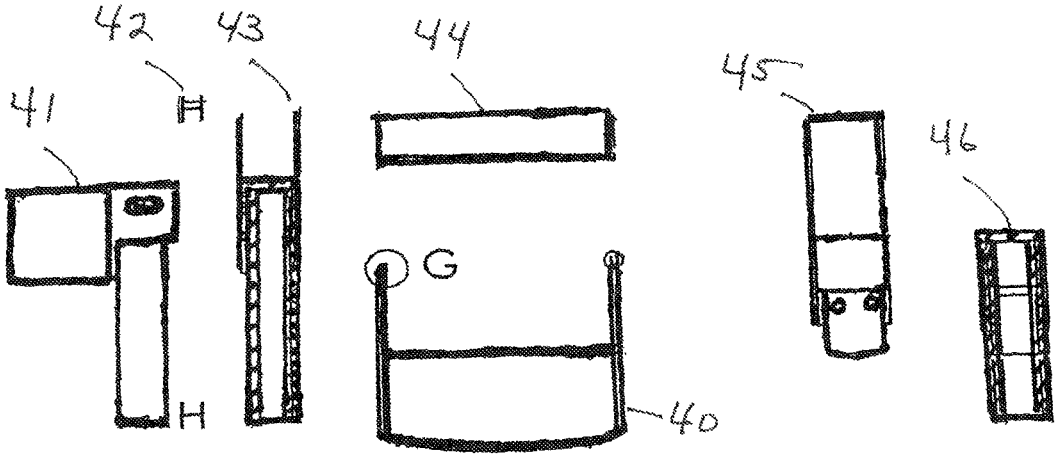
FIG. 3 shows various views of an exemplary countertop extension portion 40-46 used in the systems of the present disclosure.
Figure 4:
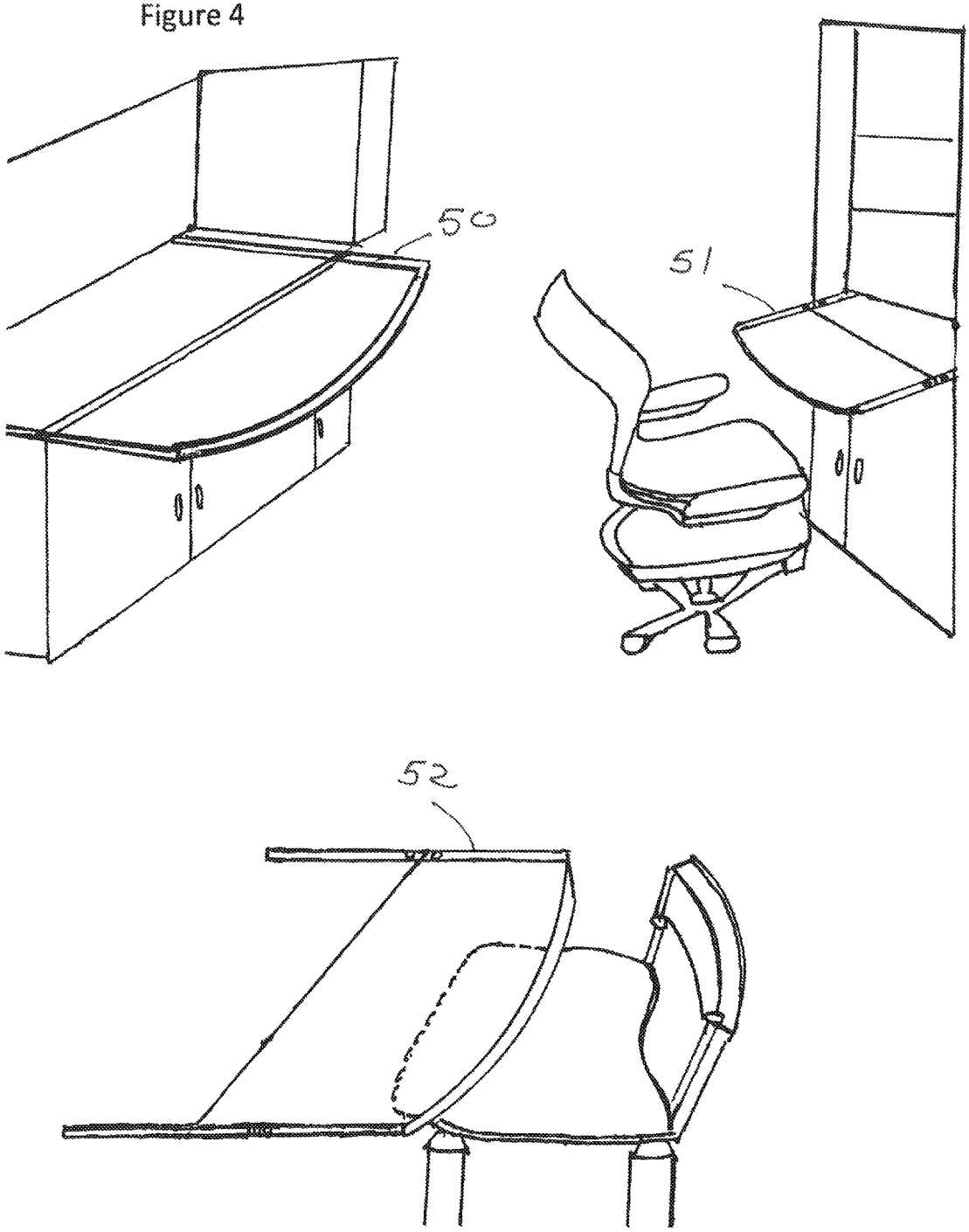

FIG. 4 demonstrates the use of the countertop extension system 50-52 to provide additional counter space where and when needed.

Figure 5:
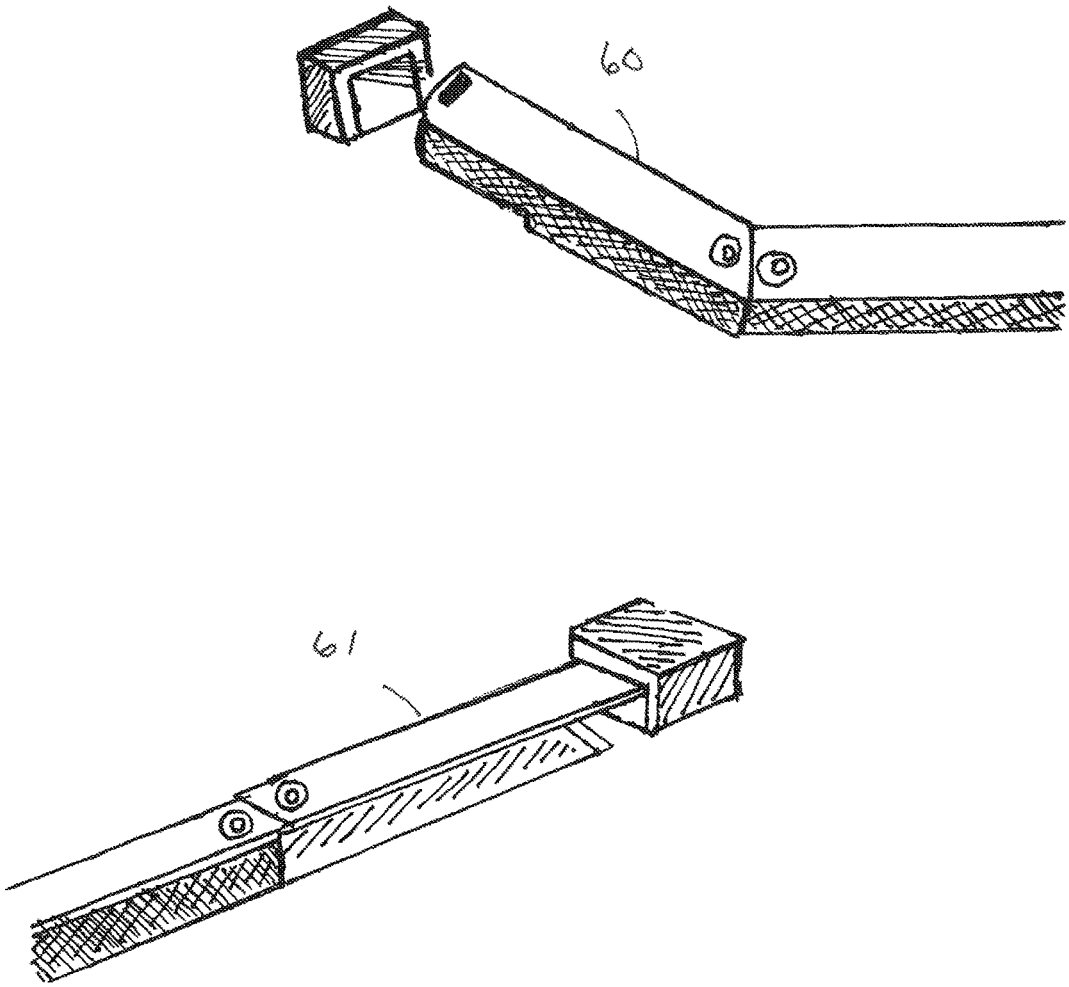

FIG. 5 shows a detailed view of the extension arms 60-61 engaging With the anchor portions to temporarily affix the countertop extension portion to an existing countertop or other suitable structure.

Figure 6:
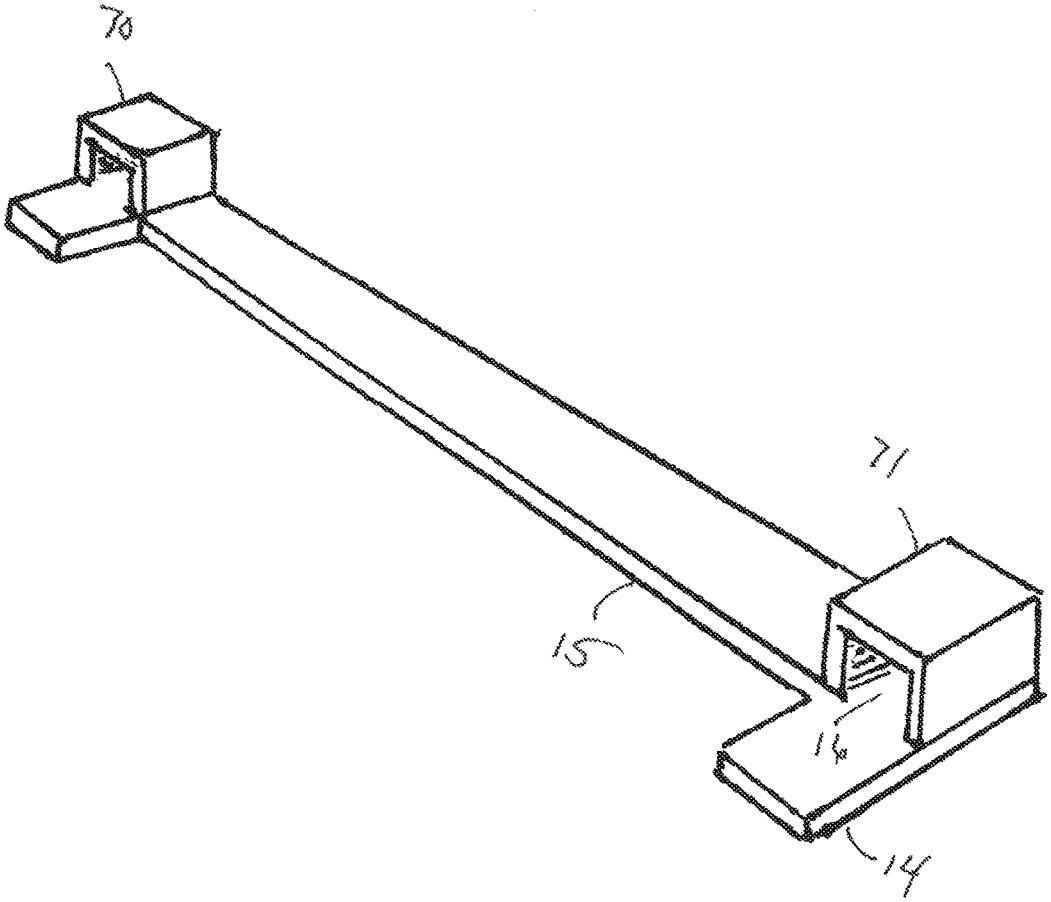

FIG. 6 shows a one piece mounting strip including two raised anchor portions 70, 71 or 'cubes', each containing a cavity with a groove on the upper inside surface to engage with a raised portion on the terminal end of the extension arms which secure and lock in place the extension arms and thus, the attached tray. To disengage and unlock press down on extension arms, slide extensions away from mounting strip. The base or strip has an industrial strength adhesive covered with a peel-off protective tape to be removed before affixing to existing suitable surface space.

* * *

The present invention is not to be limited in scope by the specific embodiments described herein. Indeed, various modifications of the invention in addition to those described herein will become apparent to those skilled in the art from the foregoing description. Such modifications are intended to fall within the scope of the appended claims.

All references cited herein, including all patents, published patent applications, and published scientific articles, are incorporated by reference in their entireties for all purposes.

What is claimed is:

1. A portable detachable counter extension system configured for attachment to an existing countertop, said portable detachable counter extension system comprising:

a countertop extension portion, the countertop extension portion comprising a substantially flat surface, and a first extension arm and a second extension arm, the two extension arms each comprising a terminal end an anchor portion, said anchor portion comprising:

a first mounting strip portion;

one or more walls extending from said first mounting strip portion to form an opening therebetween, said opening configured to slidably receive said first extension arm of said countertop extension portion therethrough;

wherein at least a portion of said first mounting strip portion extends beyond said one or more walls;

a second mounting strip portion;

one or more walls extending from said second mounting strip portion to form an opening therebetween, said opening between said second mounting strip portion and corresponding one or more walls configured to slidably receive said second extension arm of said countertop extension portion therethrough;

wherein at least a portion of said second mounting strip portion extends beyond said one or more walls that extend from said second mounting strip portion; and a third mounting strip portion configured to extend between and to connect said first mounting strip portion to said second mounting strip portion;

industrial strength adhesive applied to each of said first mounting strip portion, said second mounting strip portion, and said third mounting strip portion; and a peel-off protective tape positioned over said industrial strength adhesive, and configured to be removed therefrom prior to affixing said anchor portion to the existing countertop with said industrial strength adhesive.

2. The portable detachable counter extension system according to claim 1, further comprising a raised portion on said terminal end of said first extension arm; and wherein said first mounting strip portion and corresponding one or more walls comprise a groove on an inside surface of the opening formed therebetween, said groove configured to receive said raised portion on said terminal end of said first extension arm.

3. The portable detachable counter extension system according to claim 2, further comprising a raised portion on said terminal end of said second extension arm; and wherein said second mounting strip portion and corresponding one or more walls comprise a groove on an inside surface of the opening formed therebetween, said groove configured to receive said raised portion on said terminal end of said second extension arm.

4. A portable detachable counter extension system configured for attachment to an existing countertop, said portable detachable counter extension system comprising:

a countertop extension portion, said countertop extension portion comprising a substantially flat surface, and a first extension arm and a second extension arm, said two extension arms each comprising a terminal end an anchor portion, said anchor portion comprising:

an elongated first mounting strip portion;

one or more walls extending from said first mounting strip portion to form an opening therebetween, said opening configured to slidably receive said first extension arm of said countertop extension portion therethrough;

wherein at least a portion of said elongated first mounting strip portion extends beyond said one or more walls;

an elongated, second mourning strip portion;

one or more walls extending from said second mounting strip portion to form an opening therebetween, said opening between said second mounting strip portion and corresponding one or more walls configured to slidably receive said second extension arm of said countertop extension portion therethrough;

wherein at least a portion of said elongated second mounting strip portion extends beyond said one or more walls that extend from said second mounting strip portion;

an elongated third mounting strip portion configured to extend between and to connect said first mounting strip portion to said second mounting strip portion; and wherein each of said elongated first mounting strip portion and said elongated second mounting strip portion are elongated in a direction substantially perpendicular to an elongation direction of said elongated third mounting strip portion;

industrial strength adhesive applied to each of said first mounting strip portion, said second mounting strip portion, and said third mounting strip portion;

a peel-off protective tape positioned over said industrial strength adhesive, and configured to be removed therefrom prior to affixing said anchor portion to the existing countertop using said industrial strength adhesive;

wherein said first extension arm comprises a raised portion on its terminal end;

wherein said first mounting strip portion and corresponding one or more walls comprise a groove on an inside surface formed by said opening therebetween, said groove configured to receive said raised portion on said terminal end of said first extension arm;

wherein said second extension arm comprises a raised portion on said terminal end; and wherein said second mounting strip portion and corresponding one or more walls comprise a groove on an inside surface formed by said opening therebetween, said groove configured to receive said raised portion on said terminal end of said second extension arm.

* * * * *